US009255538B1

(12) United States Patent
Hall et al.

(10) Patent No.: US 9,255,538 B1
(45) Date of Patent: Feb. 9, 2016

(54) CONTROL SYSTEMS AND METHODS FOR MARINE ENGINES EMITTING EXHAUST GAS

(71) Applicant: Brunswick Corporation, Lake Forest, IL (US)

(72) Inventors: Ronald L. Hall, Hartford, WI (US); Roger W. Schreiber, Fremont, WI (US)

(73) Assignee: Brunswick Corporation, Lake Forest, IL (US)

( * ) Notice: Subject to any disclaimer, the term of this patent is extended or adjusted under 35 U.S.C. 154(b) by 805 days.

(21) Appl. No.: 13/629,203

(22) Filed: Sep. 27, 2012

(51) Int. Cl.
*F02D 41/14* (2006.01)

(52) U.S. Cl.
CPC ..... *F02D 41/1495* (2013.01); *F02D 41/1494* (2013.01); *F02D 41/1496* (2013.01)

(58) Field of Classification Search
CPC ..... F02D 41/1494; F02D 41/1495; F02D 41/1496
USPC ..... 701/107; 123/688, 690
See application file for complete search history.

(56) References Cited

U.S. PATENT DOCUMENTS 4,178,793 A * 12/1979 Bremer ..... F02D 41/1494 123/688
5,285,762 A * 2/1994 Werner ..... F02D 41/1479 123/690
6,034,610 A * 3/2000 Schnaibel ..... F02B 39/16 123/679
6,094,975 A * 8/2000 Hasegawa ..... F02D 41/1494 123/688
6,164,125 A * 12/2000 Kawase ..... G01N 27/4175 60/277
6,245,205 B1 * 6/2001 Schnaibel ..... F02D 41/1495 123/688
6,294,075 B1 * 9/2001 Poggio ..... F02D 41/1496 123/697
6,898,927 B2 * 5/2005 Morinaga ..... F01N 3/2006 123/688
7,467,628 B2 12/2008 Adams et al.
7,552,586 B1 6/2009 White
2002/0060150 A1 * 5/2002 Hashimoto ..... G01N 33/007 204/401
2003/0178016 A1 * 9/2003 Nebiyeloul-Kifle F02D 41/1494 123/676
2007/0010932 A1 * 1/2007 Gotoh ..... F01N 11/00 701/114
2008/0128277 A1 * 6/2008 Fukuda ..... G01N 27/4175 204/401
2014/0188371 A1 * 7/2014 Miyaji ..... F02D 41/123 701/103

* cited by examiner

*Primary Examiner* — Erick Solis
(74) *Attorney, Agent, or Firm* — Andrus Intellectual Property Law, LLP

(57) ABSTRACT

Control systems and methods are for a marine engine emitting exhaust gas. A sensor senses a characteristic of the exhaust gas. An electrical heater heats the sensor. A control circuit monitors current drawn by the heater. The control circuit controls an operational characteristic of the engine based upon the characteristic of the exhaust gas and modifies its control of the operational characteristic of the engine when the current drawn by the heater changes by a predetermined amount.

20 Claims, 3 Drawing Sheets

CONTROL SYSTEMS AND METHODS FOR MARINE ENGINES EMITTING EXHAUST GAS

FIELD

The present disclosure relates to marine engines and particularly to control systems and methods for exhaust apparatus on marine engines.

BACKGROUND

U.S. patent application Ser. No. 13/316,164, filed Dec. 9, 2011, which is incorporated herein by reference in entirety, discloses marine engine exhaust systems that include an exhaust conduit conveying engine exhaust gas from upstream to downstream, a sensor sensing oxygen content of the exhaust gas in the conduit, and a shield located in the conduit.

U.S. Pat. No. 7,552,586, which is incorporated herein by reference in entirety, discloses a marine engine exhaust system having an oxygen sensor located within a catalyst housing structure and downstream from a catalyst device.

U.S. Pat. No. 7,467,628 discloses a control system for an oxygen sensor heater. The control system includes a passive heater control module that generates a heater control signal at a first duty cycle and measures a resistance of the oxygen sensor heater. An exhaust gas temperature mapping module maps the resistance to an exhaust gas temperature. An active heater control module generates a heater control signal at a second duty cycle based on the exhaust gas temperature.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In some examples, control systems for a marine engine emitting exhaust gas comprise a sensor sensing a characteristic of the exhaust gas; an electrical heater heating the sensor; and a control circuit that monitors current drawn by the heater. The control circuit controls an operational characteristic of the engine based upon the characteristic of the exhaust gas. The control circuit modifies its control of the operational characteristic of the engine when the current drawn by the heater changes by a predetermined amount.

In other examples, methods of controlling a marine engine comprise operating a sensor to sense a characteristic of exhaust gas emitted by the engine; operating an electrical heater to heat the sensor; monitoring current drawn by the heater; controlling an operational characteristic of the engine based upon the characteristic of the exhaust gas; and modifying control of the operational characteristic of the engine when the current drawn by the heater changes by a predetermined amount.

BRIEF DESCRIPTION OF THE DRAWINGS

Examples of methods and systems for controlling shift in marine propulsion devices are described with reference to the following drawing figures. The same numbers are used throughout the drawings to reference like features and components.

DETAILED DESCRIPTION OF THE DRAWINGS

In the present description, certain terms have been used for brevity, clearness and understanding. No unnecessary limitations are to be inferred therefrom beyond the requirement of the prior art because such terms are used for descriptive purposes only and are intended to be broadly construed. The different methods and systems described herein may be used alone or in combination with other methods and systems. Various equivalents, alternatives, and modifications are possible within the scope of the appended claims.

Figure 1:
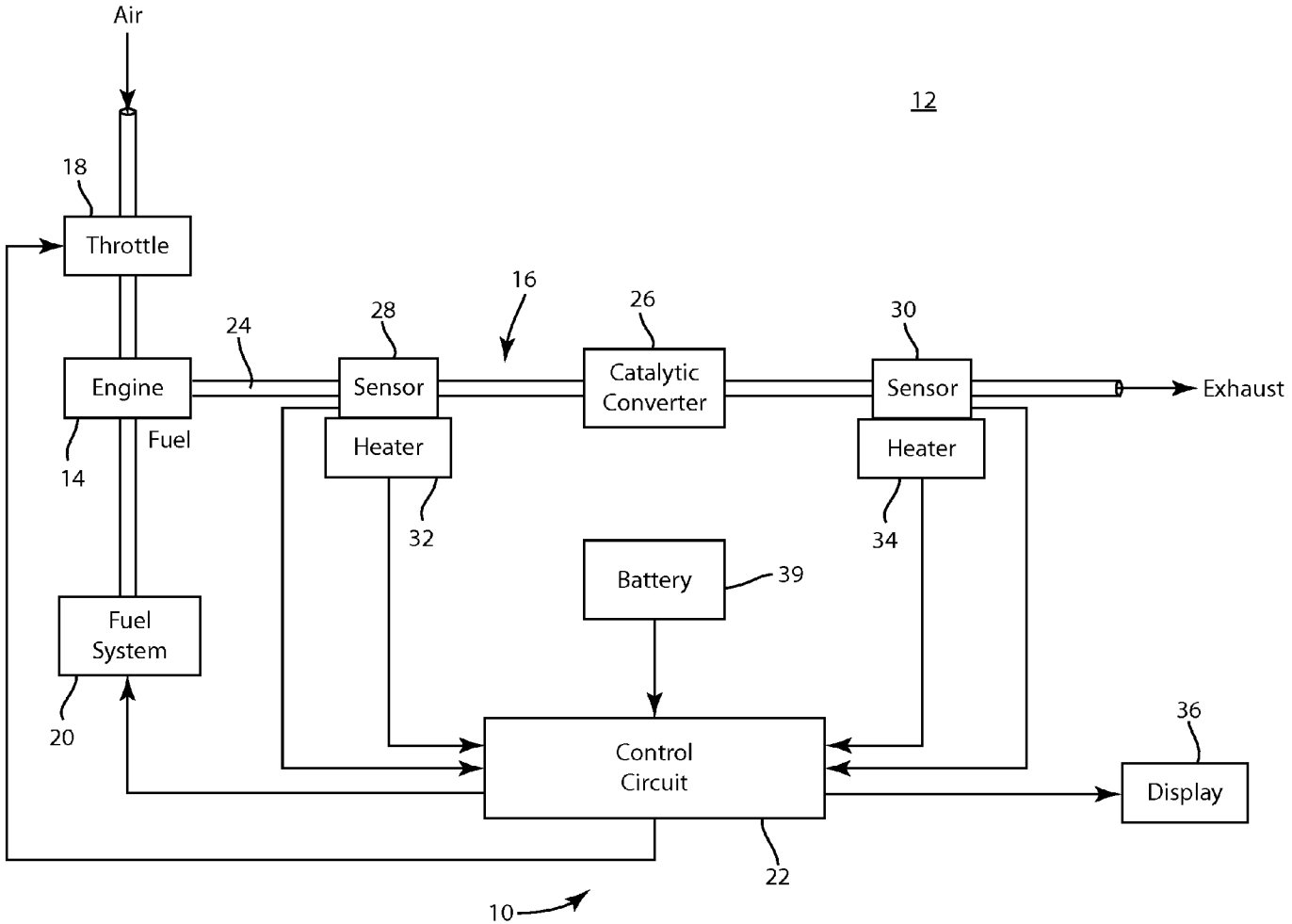
FIG. 1 schematically depicts a control system for a marine engine emitting exhaust gas.

FIG. 1 depicts a control system 10 for a marine vessel 12. The control system 10 is configured to control operational characteristics of a marine engine 14, which in the example shown is an internal combustion engine that powers a marine propulsor (not shown) such as one or more propellers, impellers, pod drives, and/or the like. The combustion process carried out by the engine 14 produces exhaust gas, which is emitted to an exhaust system 16. More specifically, flow of air into the engine 14 for combustion is controlled by a throttle 18. Flow of fuel into the engine 14 for combustion is controlled by a conventional fuel system 20, including for example one or more injectors and/or the like. Throttles for controlling air flow to an internal combustion engine are within the ordinary skill of the art and therefore are not further herein described. Fuel systems for controlling fuel flow to an internal combustion engine are within the ordinary skill of the art and therefore are not further herein described. The exhaust gas flows from the engine 14 through the noted exhaust system 16 prior to discharge from the marine vessel 12. The exhaust gas is treated in the exhaust system 16, as described further herein below, and then emitted to atmosphere.

A control circuit 22 controls operation of the throttle 18 and fuel system 20 based upon various sensed characteristics of the exhaust gas and optionally according to operational characteristics of the marine engine 14. The control circuit 22 includes a programmable processor and a memory for receiving, processing and emitting electronic control signals via respective communication links to components of the system 10. The communication links are shown in solid line format in the drawings and can comprise wire and/or wireless links.

The exhaust system 16 includes an exhaust manifold 24, through which exhaust gas is conveyed to a catalytic converter 26. Catalytic converter 26 controls emissions from the exhaust system 16 by for example altering rate of oxidation of hydrocarbons and carbon monoxide and rate of reduction of nitrogen oxides. Oxygen sensors 28, 30 sense the level of oxygen in the exhaust gas and communicate this information to the control circuit 22. Based on this information, the control circuit 22 is programmed to actively control air and fuel flow to the engine 14 via the noted throttle 18 and fuel system 20. Typically the control circuit 22 will control the throttle 18 and fuel system 20 to achieve a desired air-to-fuel ratio to thereby achieve optimum performance of the engine 14 and catalytic converter 26.

The system 10 includes one or more oxygen sensors 28, 30, which can be located at different positions in the exhaust system 16. In the particular example shown, the exhaust system 16 includes an inlet oxygen sensor 28 located upstream of the catalytic converter 26 and an outlet oxygen sensor 30 located downstream of the catalytic converter. The number and location of oxygen sensors 28, 30 can vary. For example the upstream oxygen sensor 28 can be entirely omitted. The inlet oxygen sensor 28 communicates with the control circuit 22 and measures the oxygen content of the exhaust gas entering the catalytic converter 26. The outlet oxygen sensor 30 communicates with the control circuit 22 and measures the oxygen content of the exhaust gas exiting the catalytic converter 26. The control circuit 22 controls air and fuel via the throttle 18 and fuel system 20 respectively based upon signals from the inlet and outlet oxygen sensors 28, 30 such that a sufficient level of oxygen is present in the exhaust gas to initiate oxidation in the catalytic converter 26.

Electric heaters 32, 34 are provided for each of the respective oxygen sensors 28, 30. The heaters 32, 34 are powered by a power source, such as for example the control circuit 22. The control circuit 22 receives power from a battery 39. The heaters 32, 34 are configured to heat the sensors 28, 30 to a desired operating temperature and are also configured to maintain the desired operating temperature throughout operation of the sensors 28, 30. The control circuit 22 powers the heaters 32, 34 via the noted links.

Figure 2:
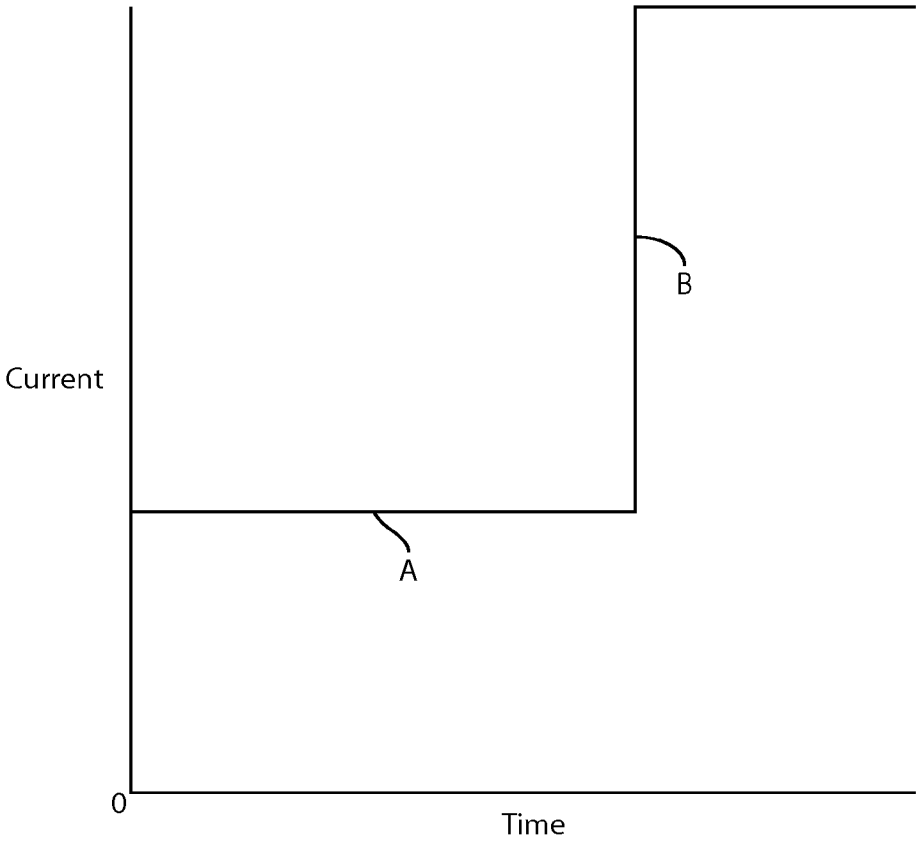
FIG. 2 is a graph depicting current drawn by a heater over time.

Referring to FIG. 2, the control circuit 22 is programmed to monitor an amount of current being drawn from the control circuit 22 by the respective heaters 32, 34. During normal operation of the sensors 32, 34, the amount of current being drawn by the heaters 32, 34 will be substantially constant, as shown at linear segment A. If one of the sensors 28, 30 malfunctions, the amount of current that is drawn by its respective heater 32, 34 will dramatically increase, as shown at linear segment B. This occurs for example when the respective sensor 28, 30 becomes wet via exposure to water in the exhaust system 16. The control circuit 22 thus can identify that a sensor 28, 30 has failed when the current draw of its respective heater 32, 34 changes by a predetermined amount. Based on this information, the control circuit 22 is programmed to modify its control of the engine 14. For example, the control circuit 22 can modify its control of the throttle 18 and/or fuel system 20 by disregarding signals received from an oxygen sensor 28, 30 that is associated with a heater 32, 34 having a change in current draw that exceeds the predetermined amount.

Thereafter, if the current drawn by the respective heater 32, 34 reverts by a predetermined amount, such as back to the amount shown at linear segment A, the control circuit 22 can be programmed to again consider signals from the respective oxygen sensor 28, 30 in its control of the engine 14. This can occur for example where the sensor 28, 30 dries out after being exposed to the water.

In the example shown, the system 10 also includes a display 36 for indicating to an operator when the current drawn by a heater 32, 34 exceeds the predetermined amount. The control circuit 22 can be programmed to operate the display 36 when the noted current draw changes by the predetermined amount.

Figure 3:
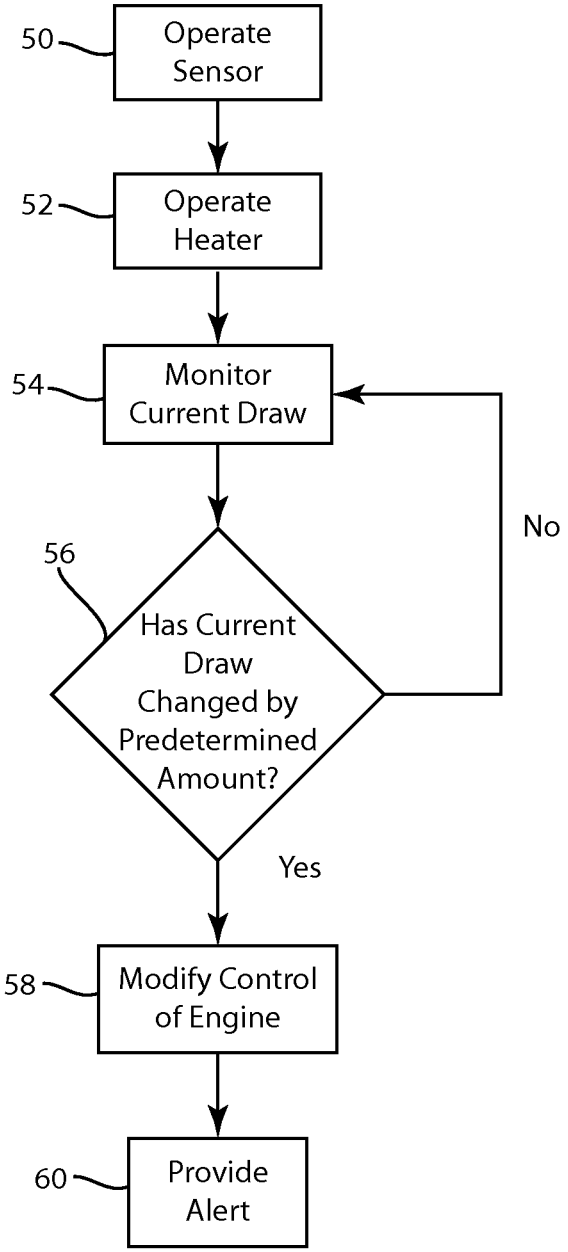
FIG. 3 is a flow chart illustrating one example of a method of controlling the marine engine shown in FIG. 1.

FIG. 3 depicts an exemplary method of controlling the marine engine 14. At step 50, a sensor is operated to sense a characteristic of exhaust gas emitted by the engine 14. In this example, the sensor is an oxygen sensor 28, 30 and the characteristic of exhaust gas is an amount of oxygen in the exhaust gas. At step 52, the electric heaters 32, 34 are operated to heat the sensors 28, 30. At step 54, the amount of current drawn by the respective heaters 32, 34 is monitored by the control circuit 22. At step 56, the control circuit 22 determines whether the amount of current drawn by the respective heater 32, 34 has changed by a predetermined amount. If no, the control circuit repeats step 54. If yes, the control circuit 22, at step 58, modifies its control of the engine 14, for example by modifying its control of the throttle 18 and/or fuel system 20. At step 60, the control circuit 22 displays an alert on the display 36 to inform an operator that the respective sensor 28, 30 is malfunctioning.

What is claimed is:

1. A control system for a marine engine emitting exhaust gas, the control system comprising:

a sensor sensing a characteristic of the exhaust gas;

an electrical heater heating the sensor; and a control circuit monitoring current drawn by the heater;

wherein the control circuit controls an operational characteristic of the engine based upon the characteristic of the exhaust gas, and wherein the control circuit modifies its control of the operational characteristic of the engine when the current drawn by the heater changes by a predetermined amount.

2. The control system according to claim 1, wherein the sensor comprises an oxygen sensor and wherein the characteristic of exhaust gas comprises an amount of oxygen in the exhaust gas.

3. The control system according to claim 1, comprising a control circuit from which the current is drawn by the heater.

4. The control system according to claim 1, wherein the control circuit modifies its control of the operational characteristic of the engine by disregarding the sensed characteristic of the exhaust gas.

5. The control system according to claim 1, wherein the operational characteristic of the engine comprises an amount of fuel provided to the engine.

6. The control system according to claim 1, wherein the operational characteristic comprises an amount of combustion air provided to the engine.

7. The control system according to claim 1, comprising a display for providing an alert when the current drawn by the heater changes by a predetermined amount.

8. A method of controlling a marine engine, the method comprising:

operating a sensor to sense a characteristic of exhaust gas emitted by the engine;

operating an electrical heater to heat the sensor;

monitoring an amount of current drawn by the heater;

controlling an operational characteristic of the engine based upon the characteristic of the exhaust gas; and modifying said control of the operational characteristic of the engine when the current drawn by the heater changes by a predetermined amount.

9. The method according to claim 8, wherein the sensor comprises an oxygen sensor and wherein the characteristic of exhaust gas comprises an amount of oxygen in the exhaust gas.

10. The method according to claim 8, comprising modifying control of the operational characteristic of the engine by disregarding the sensed characteristic of the exhaust gas.

11. The method according to claim 8, wherein the operational characteristic of the engine comprises an amount of fuel provided to the engine.

12. The method according to claim 8, wherein the operational characteristic of the engine comprises an amount of combustion air provided to the engine.

13. The method according to claim 8, comprising providing an alert when the current drawn by the heater changes by a predetermined amount.

14. A control system for a marine engine emitting exhaust gas via an exhaust conduit, the control system comprising:

a sensor disposed at least partially in the exhaust conduit and sensing an amount of oxygen in the exhaust gas;

an electrical heater heating the sensor; and a control circuit in communication with the sensor and the heater, the control circuit monitoring current drawn by the heater and also controlling throttle of the engine based upon the amount of oxygen in the exhaust gas, and wherein the control circuit modifies its control of throttle of the engine when the current drawn by the heater changes by a predetermined amount.

15. The control system according to claim 14, wherein the sensor comprises an oxygen sensor and wherein the characteristic of exhaust gas comprises an amount of oxygen in the exhaust gas.

16. The control system according to claim 14, comprising a control circuit from which the current is drawn by the heater.

17. The control system according to claim 14, wherein the control circuit modifies its control of the operational characteristic of the engine by disregarding the sensed characteristic of the exhaust gas.

18. The control system according to claim 14, wherein the operational characteristic of the engine comprises an amount of fuel provided to the engine.

19. The control system according to claim 14, wherein the operational characteristic comprises an amount of combustion air provided to the engine.

20. The control system according to claim 14, comprising a display for providing an alert when the current drawn by the heater changes by a predetermined amount.

* * * * *